US006669794B1

(12) United States Patent
Bellouard et al.

(10) Patent No.: US 6,669,794 B1
(45) Date of Patent: Dec. 30, 2003

(54) METHOD FOR TREATING AN OBJECT WITH A LASER

(75) Inventors: Yves Bellouard, Lausanne (CH); Thomas Lenhert, Prilly (CH); Jacques-Eric Bidaux, Uvrier (CH); Reymond Clavel, Oulens (CH)

(73) Assignee: Eta sa Fabriques d'Ebauches, Grenchen (CH)

( * ) Notice: Subject to any disclaimer, the term of this patent is extended or adjusted under 35 U.S.C. 154(b) by 0 days.

(21) Appl. No.: 09/857,437

(22) PCT Filed: Dec. 3, 1999

(86) PCT No.: PCT/EP99/09714

§ 371 (c)(1),
(2), (4) Date: Sep. 6, 2001

(87) PCT Pub. No.: WO00/34536

PCT Pub. Date: Jun. 15, 2000

(30) Foreign Application Priority Data

Dec. 4, 1998 (FR) ..... 98 15376

(51) Int. Cl.[7] ..... C22F 3/00; C22K 1/00
(52) U.S. Cl. ..... 148/563; 148/565
(58) Field of Search ..... 148/402, 563, 148/565; 623/1.18

(56) References Cited

U.S. PATENT DOCUMENTS

| | | | | |
|---|---|---|---|---|
| 4,371,954 A | * | 2/1983 | Cornet | 365/126 |
| 4,777,799 A | * | 10/1988 | McCoy et al. | 60/528 |
| 5,617,377 A | * | 4/1997 | Perret | 368/282 |
| 5,728,240 A | * | 3/1998 | Yamamoto et al. | 148/563 |
| 5,948,184 A | * | 9/1999 | Frantzen et al. | 148/563 |
| 6,019,860 A | * | 2/2000 | Turler et al. | 148/563 |
| 6,488,702 B1 | * | 12/2002 | Besselink | 623/1.15 |

FOREIGN PATENT DOCUMENTS

| | | |
|---|---|---|
| EP | 0 086 357 | 8/1983 |
| EP | 0 310 294 | 4/1989 |
| EP | 0 360 455 | 3/1990 |
| FR | 2 117 574 | 7/1972 |
| FR | 2 393 075 | 12/1978 |
| GB | 2 257 163 | 1/1993 |
| WO | 89 10421 | 11/1989 |
| WO | 98 24594 | 6/1998 |

OTHER PUBLICATIONS

Messer K. et al "Stand Des Laserstrahlhaertens", Haerterei Technische Mitteilungen, DE, Carl Hanser Verlag, Munich, vol. 52, No. 2, Mar. 1, 1997 pp. 74–82.

Chemical Abstracts, vol. 126, No. 24, Jun. 16, 1997; Villermaux F. et al: "Corrosion Kinetics of Laser Treated NiTi Shape Memory Alloy Biomaterials"; Mater. Res. Soc. Symp. Prco. (1997) 459 (Materials for smart systems II), 477–482, 1997.

Migliore R: "Heattreating with lasers"Advanced Materials & Processes, US, America Society for Metals, Metals Park, Ohio, vol. 154, No. 2, pp. H25–H29.

* cited by examiner

*Primary Examiner*—George Wyszomierski
(74) *Attorney, Agent, or Firm*—Sughrue Mion, PLLC

(57) ABSTRACT

The invention concerns a method whereby at least a predefined zone (A) of the object (2) is irradiated with a laser beam (4) capable of heating said zone sufficiently, to a temperature less than the material melting point, to provoke a change in the microstructure (for example crystallisation or recrystallisation) of said zone, said zone being heated at a temperature and for a time interval not rendering the material amorphous. The invention is applicable for example to reversible actuators and grippers.

7 Claims, 10 Drawing Sheets

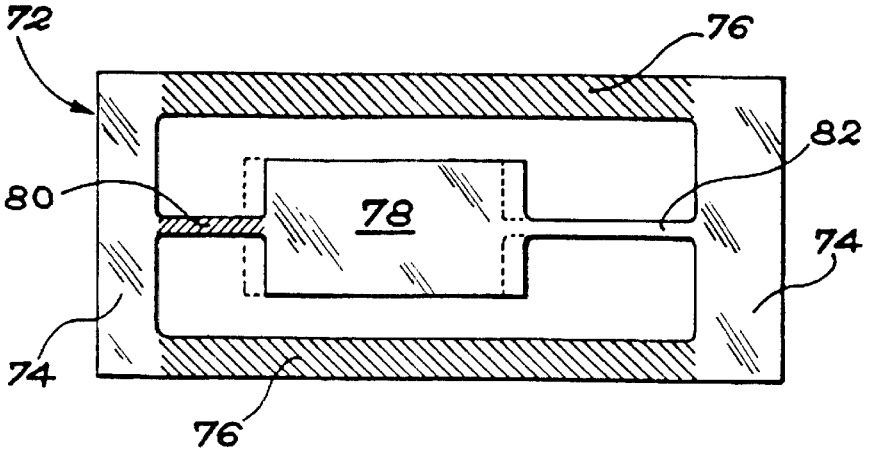
FIG. 8
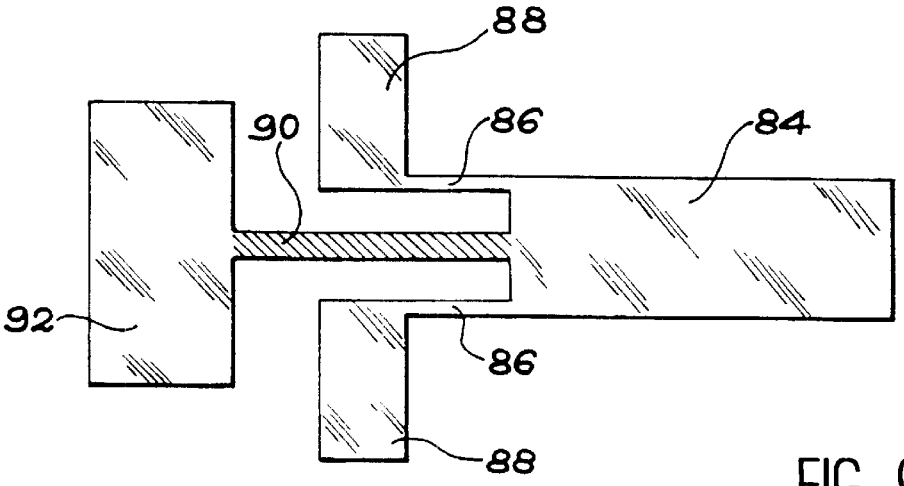
FIG. 9A
FIG. 9B
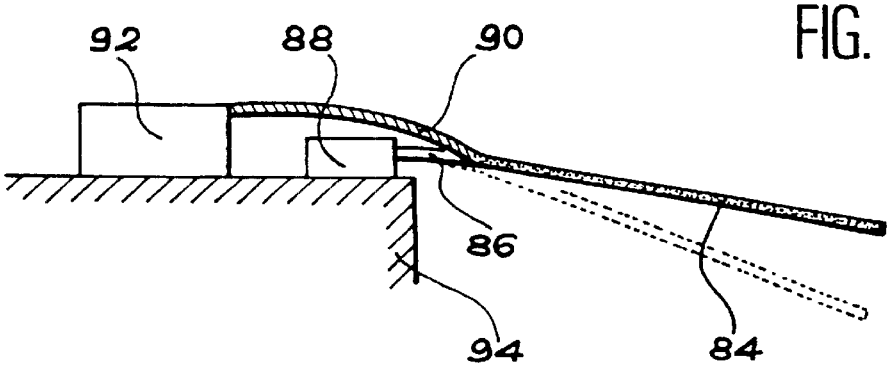

METHOD FOR TREATING AN OBJECT WITH A LASER

FIELD OF THE INVENTION

The present invention concerns a treatment method for an object made of a material exhibiting martensitic transformation, in particular a shape memory material.

The invention applies to the manufacture of active or passive monolithic structures (i.e. one single piece of material), made of shape memory material, and in particular to the manufacture of monolithic actuators, connectors, active components for fixing and grippers, of very small dimensions, made of shape memory material.

DESCRIPTION OF THE PRIOR ART

The following two documents should be consulted as regards shape memory materials:

[1] Engineering Aspects of Shape Memory Alloys, T. W. Duerig et al., Ed. Butterworth-Heinemann, 1990

[2] Shape memory materials, Edited by K. Otsuka and C. M. Wayman, Cambridge University Press, 1998, chapter 10, pages 21 to 237

The following document which divulges particular applications of these materials should also be consulted:

[3] French Patent Application No. 9615013 of Dec. 6, 1996, "Dispositif de préhension en matériau à mémoire de forme et procédé de réalisation", an invention by Y. Bellouard, J. E. Bidaux and T. Sidler—see also International Application No. PCT/EP97106966, International Publication No. WO 98/24594.

It will be recalled that shape memory materials have several solid phases in mestastable equilibrium. The change of phase from a solid phase to another may be induced under stress (super-elasticity) and/or by temperature change (shape memory effect).

When the change of phase is heat induced, it may be accompanied by a macroscopic shape change. Thus a shape memory material which is apparently plastically deformed in its low temperature phase, called the "martensite phase" can return to its initial shape by being heated to its high temperature phase, called the "austenite phase".

The characteristic temperatures of the beginning and end of the austenite-martensite transformation are respectively designated $M_a$ and $M_f$. The characteristic temperatures of the beginning and end of the martensite-austenite transformation are respectively designated $A_s$ and $A_f$.

Particular care must be taken that there exists only one "memorised" shape in a shape memory material, namely the austenite shape: the phenomenon is thus not intrinsically reversible.

Obtaining an intrinsic reversible effect for such a material requires either the use of a very particular manufacturing method of the material (for example the method known by the name of "Melt Spinning"), or the use of a thermo-mechanical treatment commonly called the "education method" which will in a way "memorise" a preferred martensite shape.

Another known technique consists in exploiting the fact that the mechanical characteristic of the material evolves with the change of phase. Thus, a mechanical assembly including on the one hand an element made of such a material and on the other hand another element whose characteristic remains constant will have two stable operating points corresponding to the temperature and stress zones defining the solid phases of this shape memory material.

However, when one wishes to obtain an actuator of very small dimensions, it is very difficult to make such an assembly. This is why, a known technique consists in creating a single piece structure which is also called a monolithic structure: the actuator is then manufactured in a single same element made of a memory shape material.

In this regard, the following document should be consulted:

[4] Y. Bellouard et al., "A concept for monolithic SMA microdevices", Journal de Physique IV, n°11, p.603–608 (1997).

The difficulty is thus to be able to obtain a reversible effect and for such purpose to obtain different mechanical properties in this same element: In order to do this, it is necessary to heat the latter locally so that only a part thereof can have a shape memory effect while the other part remains passive.

However, in order for a displacement to occur, it is imperative to achieve mechanically an initial pre-deformation of the element (except if there is a two-way memory effect).

EP-A-0 086 357 A discloses a method for manufacturing a crank case wherein the surface layer material of the case is transformed from a ferritic state to a substantially martensitic state.

MESSER K ET AL: "STAND DES LASERSTRAHL-HAERTENS" HAERTEREI TECHNISCHE MITTEILUNGEN, DE, CARL HANSER VERLAG, MUNCHEN, vol. 52, no. 2, Mar. 1, 1997 (1997-03-01), pages 74–82 discloses the laser beam hardening of iron based alloys.

MIGLIOREL L R: "HEAT TREATING WITH LASERS" ADVANCED MATERIAL'S & PROCESSES, US, AMERICA SOCIETY FOR METALS. METALS PARK, Ohio, vol. 154, no. 2, Aug. 1, 1998 (1998-08-01), pages H25–H29 discloses the treatment by laser of steels.

FR-A-2 393 075 discloses the annealing of a non ferrous metal part by means of a laser.

CHEMICAL ABSTRACTS, vol. 126, no. 24, Jun. 16, 1997 (1997-06-16) Columbus, Ohio, US; abstract no. 319898, VILLERMAUX, F. ET AL: "Corrosion kinetics of laser treated NiTi shape memory alloy biomaterials" & MATER. RES. SOC. SYMP. PROC (1997), 459 (MATERIALS FOR SMART SYSTEMS II), 477–482, 1997 discloses the laser treatment of shape memory alloys.

WO-A-89 10421 discloses heat treatment of shape memory alloys.

SUMMARY OF THE INVENTION

The object of the present invention is to overcome the problem of local change (i.e. at least in a pre-defined zone) of the microstructure of an object made of a material exhibiting martensitic transformation, in particular a shape memory material.

"Local change of the microstructure" of such an object means:

- the local crystallisation of the object when the material is amorphous
- or the local recrystallisation of the object when the material is work-hardened
- or the secondary local crystallisation of the object when the material is already crystallised (for example to induce locally a transformation temperature change)
- or the controlled formation of precipitates or the annihilation of crystalline faults, locally, in the object (with a view to locally changing the mechanical properties of the latter).

More precisely, the present invention concerns a treatment method for an object made of a material able to undergo martensitic transformation, in particular a shape memory material this method being characterised in that at least a pre-defined zone of this object is irradiated by a laser beam able to heat this zone sufficiently, to a temperature lower than the melting temperature of the material, to cause, in said zone, a microstructure change selected from among a crystallisation, recrystallisation, secondary crystallisation controlled formation of precipitates and annihilation of crystalline faults, said zone being heated to a temperature and for a time which are not able to cause amorphisation of the material.

This laser beam is thus used to anneal the object locally by bringing the latter to a much higher temperature T than the temperature $A_f$ of the shape memory material of which the object is made.

However, it should be noted that the temperature and the annealing time are such that amorphisation of the material cannot be obtained.

It should also be noted that the material could even have been annealed in a furnace prior to implementing the method of the invention.

Irradiating a zone of an element made of shape memory alloy by means of a laser beam is of course known, from European Patent document Nos. 0360455A and 031 0294A (Catheter Research Inc.). The use of a laser to modify and alter the crystalline structure so that the martensitic transformation can no longer occur is divulged therein. The notion of altering is important in the sense where, in the case of these documents, the laser is used to "destroy" and not to "construct" a crystal lattice. This means that the element is annealed beforehand then locally "amorphised" to prevent the migration of contaminating ions such as the silver ions in the NiTi matrix of the element. It is thus a method with an object contrary to the object of the method of the present invention. Indeed, the object of local annealing by laser is to crystallise or recrystallise locally a material exhibiting martensitic transformation (in particular a shape memory material) and not to amorphise it. Amorphisation by heating can be obtained when the rise in temperature is very high, i.e. close to the melting temperature, and cooling occurs extremely quickly.

The method of the present invention has numerous advantages:

- This method can be implemented with an inexpensive device and allows annealing of structures made of shape memory material to be achieved simply, without using a furnace (the duration of the treatment according to the invention being much shorter than that of annealing effected by means of a furnace). Moreover, such a method can easily be implemented in a production line.
- This method allows small pre-defined zones to be annealed in complex structures, in a very precise manner.
- This method is compatible with great freedom of conception of the structures with which it is to be implemented (whereas local annealing by means of an electric current would require a well defined and dimensioned current path).
- With this method, the rise in temperature occurs very quickly and cooling depends only on the size of the object to be annealed. This allows annealing qualities, which are difficult to obtain with a furnace, to be obtained. By way of example, hardening at the end of annealing is no longer necessary with the invention.
- This method is very well suited to the production of micro-electro-mechanical systems or MEMS, may be integrated in a microsystem manufacturing method and allows quick production of the latter.
- This method is the only one which allows reversible actuators, of very small dimensions, to be obtained without the use of stress obtained by mechanical pre-deformation effected by an operator. The invention allows this pre-deformation to be introduced during annealing.
- The applications of the invention are numerous and are located in particular in the microtechniques (MEMS): it allows for example micro-switches to be manufactured for fibre optics, modulators, grippers, active fixations, axes of translation and axes of rotations, which are monolithic.

According to a first particular implementation mode of the method of the invention, said irradiation of the zone is also used to cause permanent deformation of this zone allowing the object to be stressed. In this case, the laser is thus used to pre-deform the object by annealing.

According to a second particular implementation mode, before and during, or after irradiation of the zone, the object is stressed by the deformation of said object. In this case, an initial mechanical pre-deformation of the object is thus made, unlike the preceding case.

The non-irradiated part of the object can be all in one piece or, conversely, this non-irradiated zone may include at least two zones which are separated by the irradiated zone.

According to a particular embodiment of the invention, the object is a thin element and zones of this elements, which are distributed over said element with a view to rigidifying the latter, are irradiated, by means of said laser beam.

In the present invention, the energy transmitted to the material by the laser can be varied as a function of the position of the laser beam on the object.

In order to do this, one can for example vary, as a function of this position, the power of the laser, the duration of the laser pulse, the sequence of successive shots, or vary the zone sweep speed by the laser beam.

The invention also concerns objects obtained via methods according to the invention.

According to a first particular embodiment of the invention, the object constitutes a plane monolithic device at least one part of which is able to undergo a reversible movement in the plane of the device, as a function of the temperature of the zone which has been crystallised or recrystallised by irradiation.

According to a first example, this device constitutes a gripper including a fixed part and a moving arm forming a return spring one end of which is connected to this fixed part by said zone, the moving arm being deformed by a user after crystallisation or recrystallisation of this zone by irradiation, to subject the gripper to stress.

According to a second example, this device constitutes an actuator including at least a fixed part and at least a moving part, this moving part being connected to the fixed part by a first element, which constitutes said zone and forms the motor element of the actuator, and by a second element which is able to exert a return force on the moving part.

According to a third example, this device constitutes an actuator including a first zone crystallised or recrystallised by irradiation by the laser beam, this first zone being used to put the actuator under stress, and a second zone crystallised or recrystallised by irradiation by the laser beam, this second zone forming the motor-element of the actuator and being distinct from the first zone.

According to a second particular embodiment of the invention, the object constitutes a monolithic device including a first plane part and a second part able to undergo a reversible movement outside the plane of the first part, as a function of the temperature of the zone which has been crystallised or recrystallised by irradiation.

BRIEF DESCRIPTION OF THE DRAWINGS

The present invention will be better understood upon reading the description of embodiment examples given hereinafter, purely by way of non-limiting indication, with reference to the annexed drawings, in which:

FIG. 8 is a schematic view of an actuator, the manufacture of which uses the method of the invention, FIG. 9A is a schematic top view of another actuator, the manufacture of which uses annealing in accordance with the method of the invention while FIG. 9B is a profile view of this other actuator after annealing.

DETAILED DESCRIPTION OF PARTICULAR EMBODIMENTS

Figure 1:
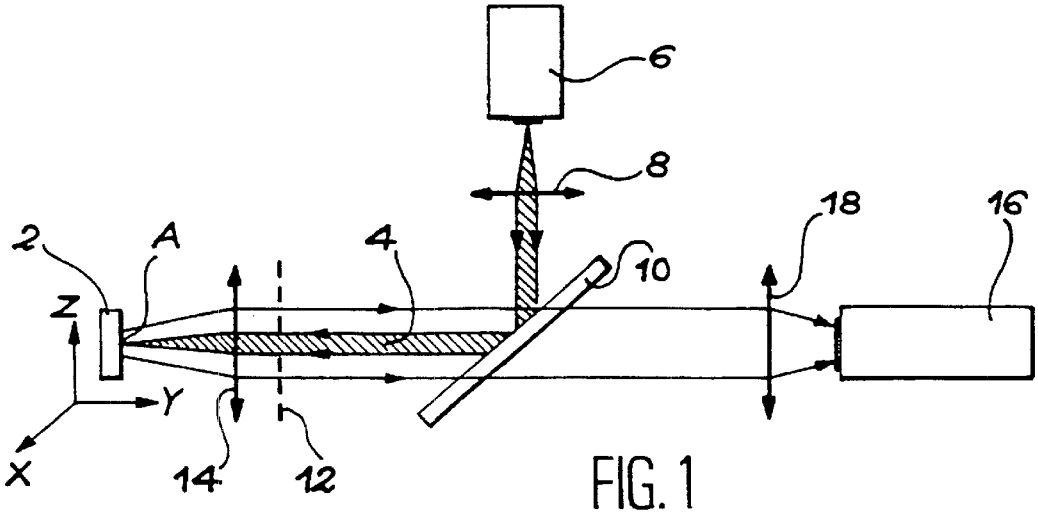
FIG. 1 is a schematic view of a device allowing the method of the invention to be implemented.

FIG. 1 is a schematic view of a device allowing implementation of a method according to the invention.

According to this method, one or several zones such as zone A of an object 2 made of a material exhibiting martensitic transformation, for example a shape memory material, is irradiated, by a laser beam 4. This beam 4 is able to bring zone A to a sufficient temperature T for crystallisation, recrystallisation, or secondary crystallisation of this zone, or the controlled formation of precipitates or annihilation of crystalline faults in this zone. Further, as has been seen, the heating time and temperature are such that amorphisation of the material does not occur.

Purely by way of non-limiting indication, the shape memory material of which object 2 is formed, is a NiTi alloy for which a temperature T of the order of 500° C. is suitable.

However, other shape memory materials, such as CuZnAl or NiTiCu can be used in the invention.

One may also use, in the invention, the materials described in document [1], chapter 1, pages 3 to 20, drafted by C. M. Wayman and entitled, "Introduction to martensite and shape memory".

The device of FIG. 1 includes a laser 6, for example a diode laser of the type marketed by the Siemens company under the reference S/N 150001B and the wavelength of which is equal to 810.5 nm.

Object 2 is mounted on a positioning system with three degrees of freedom which is symbolised by the axes X, Y and Z which are perpendicular to each other and which allows object 2 to be placed in laser beam 4 transmitted by diode 6.

This laser beam is sent to zone A via, successively, a collimation lens 8, a semi-transparent mirror 10, a diaphragm 12 and a lens 14 for focusing the beam on the object.

As is seen in FIG. 1, a camera 16, for example a CCD camera, is provided for observing irradiated zone A via, successively, lens 14, diaphragm 12, semi-transparent mirror 10 and an optical device 18.

This camera allows the position of the object to be adjusted in laser beam 4.

The electric current supply of the laser diode includes an arbitrary signal generator (not shown) allowing laser-pulses of a determined power and duration to be obtained.

The advantage of having one or several zones in the crystalline state and one or several zones in the amorphous or hardened state in the same shape memory material is that two or more different mechanical properties can be obtained (for example shape memory effect, super-elasticity, different transformation temperatures) in the same material. One can thus manufacture an actuator whose active part is the laser annealed zone, the non-annealed zones having another active role (movement at different temperatures) or passive role (for example as a guide or return spring) in the actuator.

Figure 2:
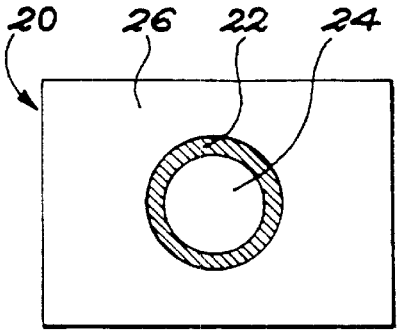
FIG. 2 is a schematic view of an object wherein the non annealed part is not in all in one piece.

FIG. 2 is a schematic view of a thin strip 20 made of a non-annealed shape memory material, for example an amorphous material.

A zone 22 of circular shape of this thin strip has undergone annealing by laser beam in accordance with the invention.

Zones 24 and 26 which have not undergone annealing can be seen in FIG. 2. Zone 24 is surrounded by zone 22 and zone 26 surrounds zone 22.

Owing to the shape of annealed zone 22, these zones 24 and 26 are stressed, thus providing a reversible shape memory effect and the possibility of obtaining a reversible actuator.

In the example of FIG. 2, the zone which is not annealed by laser is not all in one piece: it is formed of zones 24 and 26 separated by zone 22.

Figure 3:
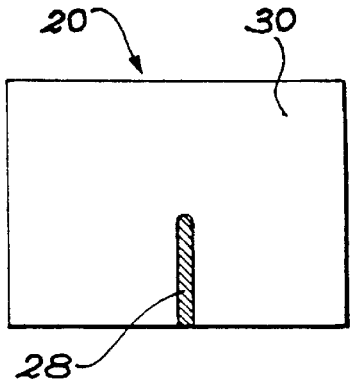
FIG. 3 is a schematic view of an object wherein the non annealed part is all in one piece.

Conversely, in the example of FIG. 3, another thin strip 20 made of a shape memory material which is not locally annealed, for example an amorphous material, is seen, a substantially rectilinear zone 28 of which has undergone laser annealing in accordance with the invention, this zone 28 extending from one edge of strip 20 towards the centre of the latter. Consequently, zone 30 which is not subjected to laser annealing is all in one piece.

This zone 30 is again subjected to stress thus providing a reversible shape memory effect.

When the invention is implemented, it is possible to vary the annealing temperature by varying the power of the laser beam or, more generally, the energy transmitted to the object by the laser (by varying the intensity of the supply current of diode 6 in the example of FIG. 1) during annealing, as a function of the position of the laser spot on the object to be treated.

It is known that transformation temperatures evolve with the annealing parameters (time, temperature).

One may for example sweep the zone to be annealed for the purpose of varying locally the characteristic temperatures of the shape memory material from which the object is made, i.e. the parameters $M_s$, $M_f$, $A_s$ and $A_f$ of this material.

This has the advantage of extending the martensite-austenite transition zone of the material.

It should be noted that the shape memory material annealed in accordance with the invention can become super-elastic in the annealed zone.

The method of the invention can thus also be used when one wishes to make a shape memory material super-elastic locally.

Figure 4:
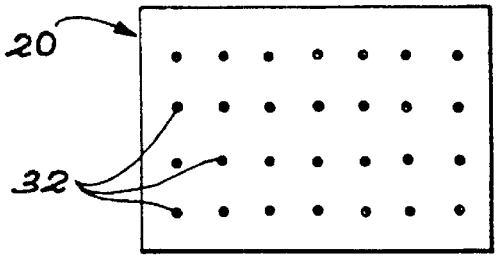
FIG. 4 is a schematic view of a strip rigidified by a method according to the invention.

FIG. 4 illustrates schematically an other application of the invention to the stiffening of a thin strip 20 made of shape memory material.

Points 32 of strip 20 are annealed by laser, these points being distributed in a substantially uniform manner on the surface of the strip.

Stresses are thus created locally in strip 20 around laser impact points 32. This allows the strip to be rigidified, in particular when loaded in bending.

FIGS. 5, 6, 7, 8 and 9A, 9B illustrate schematically various devices which are capable of having very small dimensions and the manufacture of which uses a method according to the invention.

Purely by way of non-limiting indication, these devices can be made with dimensions of less than 500 $\mu$m and thicknesses of the order of 1 $\mu$m to 200 $\mu$m so that they can be considered micro-devices.

Figure 5:
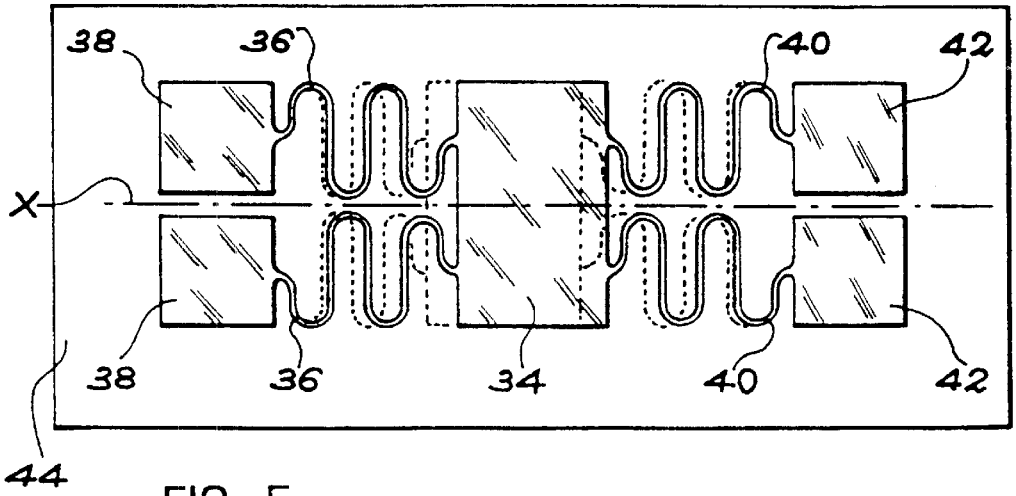
FIG. 5 is a schematic view of a translation stage along an axis, the manufacture of which uses the method of the invention.
Figure 6:
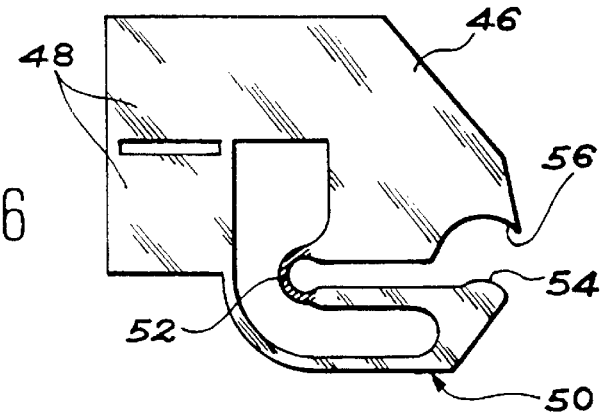
FIG. 6 is a schematic view of a gripper the manufacture of which uses the method of the invention.

In the case of each of FIGS. 5 and 6, an operator has to deform the device so as to stress the latter after having annealed a part of this device in accordance with the invention.

However, in the case of FIG. 5, deformation by an operator can also occur before (and during) annealing.

In such case, the device is first fixed onto a support via its pads; the central mobile part is moved by the operator then held stressed and the springs compressed by this stress are annealed. Then the device returns to a position of equilibrium.

In the case of deformation effected after annealing (case of the example considered hereinbelow), the device is free, a part (the two springs on the left of FIG. 5) is annealed; then the device is stressed and secured.

Conversely, in the case of each of the devices of FIGS. 7, 8 and 9A, 9B, the permanent deformation, induced by annealing, of the zone which undergoes annealing, can be exploited; the annealing thus allows the device to be stressed.

It is to be specified that deformation of the object always occurs during laser annealing. This deformation is small with respect to the deformation which an operator can induce.

This deformation will thus be exploited a priori in devices which amplify it (case of the examples of FIGS. 7 and 9A, 9B) or in the case of very small movements (example of FIG. 8).

This deformation may be a permanent contraction or expansion, depending upon the parameters of the laser pulse.

Moreover, in the case of each of FIGS. 5 to 8, there is a plane monolithic device a part of which is able to undergo a reversible movement in the plane of the device.

Conversely, the device of FIGS. 9A and 9B is a monolithic device including a first part which is plane and a second part which is able to undergo a reversible movement outside the plane of the first part.

Figure 7:
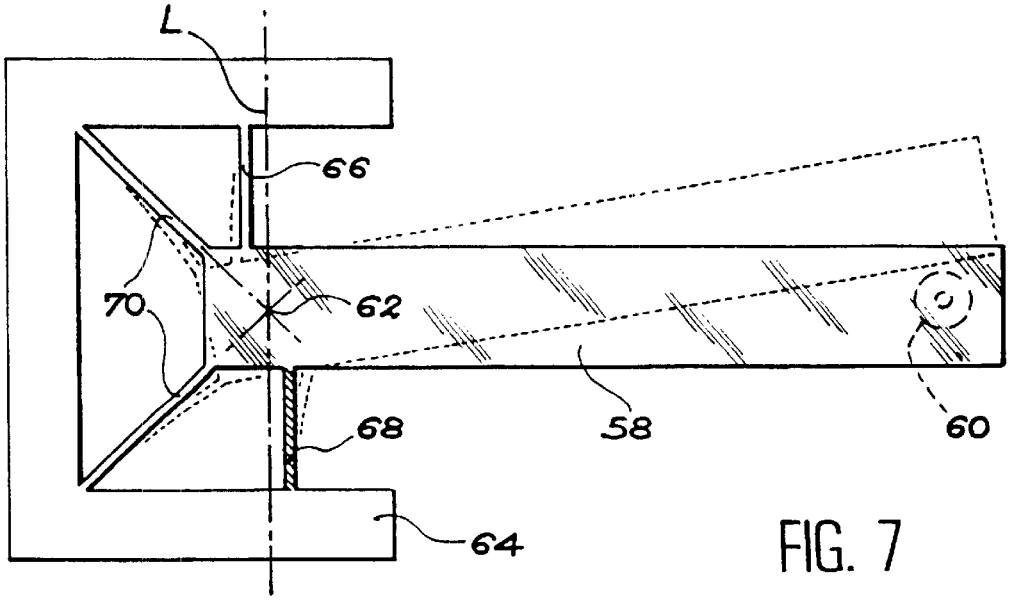
FIG. 7 is a schematic view of an optical switch, the manufacture of which uses the method of the invention.

Furthermore, in the case of each of the devices of FIGS. 7 and 9A, 9B, the element used for pre-stressing the device is also the active element of the device, while, in the case of the device of FIG. 8, the element used for pre-stressing the device is different from the active element of the device.

The device of FIG. 5 is a translation stage along an axis X.

This device is cut out by laser from a thin strip made of shape memory alloy.

It can be seen that this device includes a central mobile part 34, two springs 36 secured, on one side, to the latter and, on the other side, to two pads 38, two other springs 40 secured, on one side, to the mobile part and, on the other side, to two other pads 42.

The two springs 36, located on the left of the Figure, are heated to their annealing temperature by a laser beam in accordance with the invention.

The two springs 40, located on the right of the Figure, remain substantially at ambient temperature (approximately 20° C.).

After cooling the entire device to ambient temperature, the four springs are pre-stressed along axis X (axis of translation) and the device is secured via the four pads on a plane substrate 44.

The operating principle of this device is as follows: springs 36 are heated above the transformation temperature Ax which is of the order of 60° C. for an NiTi or NiTiCu alloy.

The heating can be achieved for example by an electric current which is made to flow in the two springs.

The latter transform into austenite, thus return to their initial shape and pull the mobile part towards the left.

During cooling, these two springs 36 return to their martensitic state and the mobile part is pulled towards the right because of the elasticity of springs 40 which have not been annealed and which form return springs for the device.

Another possible operating mode (deformation before—and during—annealing) was explained above.

The device of which FIG. 6 is a schematic top view, is a micro-gripper which is cut by laser from a thin strip of shape memory material.

This device includes a fixed part 46, including two securing zones 48, and an actuating part 50 intended to form a return spring.

One end of this actuating part is connected to fixed part 46 via a semi-circular part 52, intended to be laser annealed in accordance with the invention.

The other end 54 of the actuating part and a zone 56 of the fixed part, which is located facing this other end 54, constitute the jaws of the device.

For the local annealing of zone 52 a laser beam is projected onto the latter.

After returning to ambient temperature, the arm of the gripper (i.e. part 50 thereof) is then deformed outside its elastic domain in order to define the open position of the gripper.

This device thus remains open and has a certain elasticity.

If one wishes to pick up an object with the gripper, the whole of the device is heated for example by means of a Peltier element. The gripper closes because of the force generated by the phase transformation in the annealed part.

During cooling, when the actuating part has returned to the martensite state, the return spring is able to pull the arm in its open position.

The device of FIG. 7 is an optical switch which is cut, for example by laser, from a thin strip of amorphous shape memory material.

It includes an arm 58 intended to move so that one of its two ends can interrupt or, conversely, allow a light beam from a fibre optic 60 to pass.

In the other end of this arm there is a virtual rotational centre 62.

One can also see a fixed part 64 of the device, in the shape of a C, which is connected to a side of the end of arm 58 where the virtual rotational centre is located via an element 66 forming a spring and to the other side of this end via another element 68 intended to be annealed by laser in accordance with the invention.

Two substantially rectilinear guide elements 70 can also be seen, also connecting fixed part 64 to this end of the arm where the virtual rotational centre is located such that virtual extensions of these two elements 70 intersect at the virtual rotational centre.

It is to be specified that the element forming a spring 66 and element 68 intended to be annealed by laser are located on either side of a line L which passes through the virtual rotational centre and which is substantially perpendicular to arm 58.

Let us suppose that element 68 becomes elongated during annealing.

The austenitic shape of this element 68 is thus an elongated shape.

At ambient temperature, since element 68 is in its martensitic state, spring 66 tends to compress element 68. Arm 58 returns (approximately) to its initial position.

When it is heated, element 68 passes into the austenitic phase, becomes elongated and causes arm 58 to rotate in the anti-clockwise direction (upwards in the example of FIG. 7).

The shape of elements 66 and 68 may be adapted depending upon the desired characteristics.

It is to be specified that the two elements 70 are facultative guide means.

The device of FIG. 8 is formed from a thin strip of shape memory material.

It is an actuator including a fixed part 72 having substantially the shape of a rectangular frame two sides 74 of which are not annealed by laser while the other two sides 76 are annealed by laser in accordance with the invention.

Moreover, this device includes a mobile part 78 comprised between the two sides 76 and this mobile part is connected to the two non-annealed sides 74 respectively by an element 80 which is also annealed by laser in accordance with the invention and by another element 82 which is not annealed forming a return spring.

The moving part is intended to move in translation substantially parallel to the two annealed sides 76.

When it is annealed, element 80 expands very little.

When the two sides 76 are annealed (by a laser beam to anneal these sides in the same conditions), these two sides expand more than element 80 and subject the device to traction stress.

If this element 80 is heated (without of course annealing it again), it contracts and pulls mobile part 78.

When the device returns to ambient temperature, the element forming a spring 82 pulls the moving part 78.

The device shown in top view in FIG. 9*a* is cut from a thin strip of amorphous shape memory material.

This device includes an arm 84 one end of which is extended by two bars 86 respectively secured to two pads 88.

A bar 90 is comprised between these two bars 86 and one of its ends is also secured to this end of arm 84.

The other end of bar 80 is secured to a pad 92.

The device thereby obtained is secured to a plane support (not shown) via pads 88 and 92.

Central bar 90 is then annealed by laser in accordance with the invention.

Deformation, which may be a contraction or expansion depending on the parameters of the laser pulse, as was seen above, and which is induced during annealing, causes arm 84 to be displaced out of the plane of the support as shown in FIG. 9B which is a schematic profile view of the device after laser annealing.

It can be seen in FIG. 9B that the device is secured to its support 94 such that arm 84 is located outside this support.

In the example of FIG. 9B is has been assumed that the laser annealed arm has become elongated.

The non-annealed bars 86 form return springs which were stressed during annealing.

If the whole device or only the annealed bar is heated (for example by a Peltier element or by Joule effect or by a very low power laser beam) so as to obtain the martensitic transformation of annealed bar 90, the latter is deformed, which causes the whole of arm 84 to move.

The device of FIGS. 9A and 9B can be used as an optical switch or more generally as an actuator.

By combining two or three devices of this kind a gripper may even be formed, the two or three mobile arms of the latter then being used to grip an object.

The present invention has other applications:

The object treated in accordance with the invention may be a monolithic structure including particular zones, for example, articulations, and the particular zones are then irradiated by the laser beam to make them super-elastic.

In another example, the object is a single piece system which is made multi-functional by irradiating, by means of the laser beam, various zones of this system, and transmitting, to such zones, by means of the laser, different energies, the zones being intended for example to form different actuators acting at different temperatures.

In yet another example, the object is a monolithic structure including zones which are irradiated by the laser beam at different energies to obtain a shape memory effect in certain zones, for example in order to form actuators therefrom, and to make the other zones super-elastic, for example in order to form guide articulations with these other zones.

Figure 10:
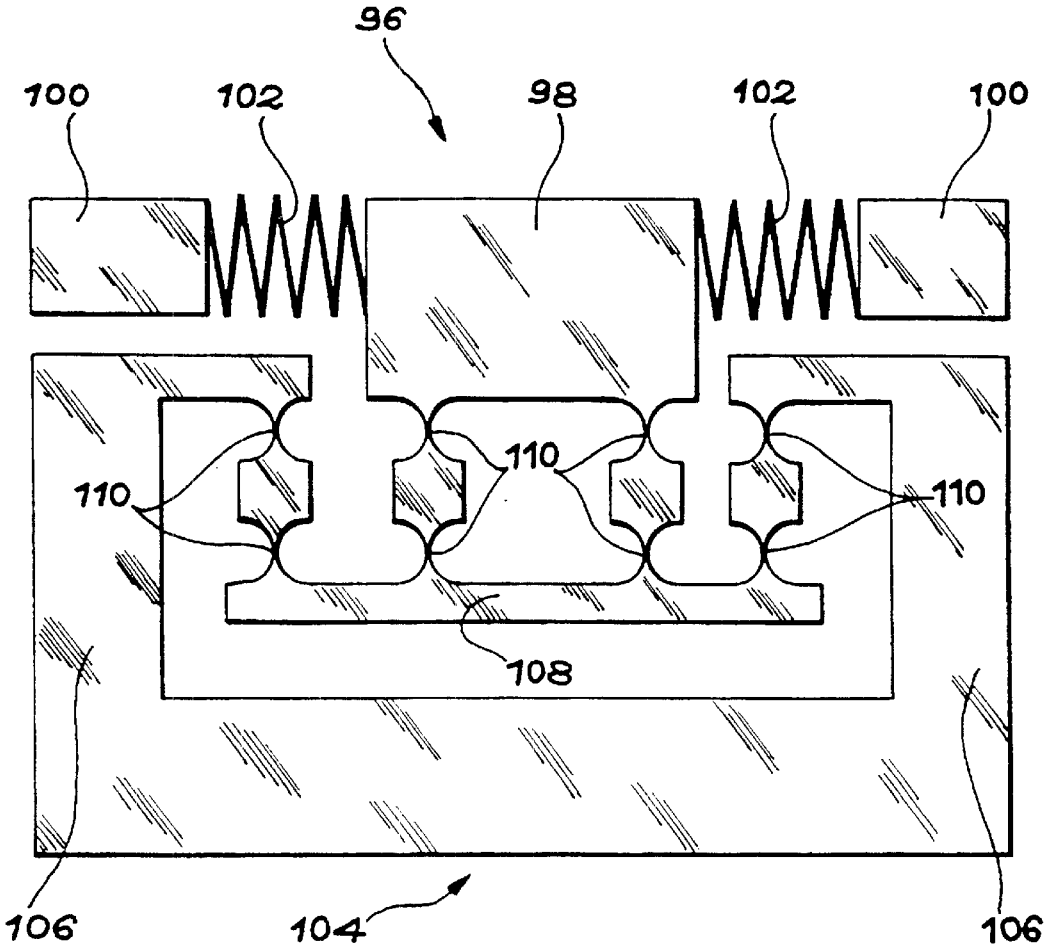
FIG. 10 is a schematic view of a translation table which is provided with guide elements, with articulations, and the manufacture of which uses the method of the invention.

This is schematically illustrated in FIG. 10.

The single piece system made of shape memory material shown in FIG. 10 includes a translation device 96 which can be compared to the device of FIG. 5 and which includes a mobile table 98 connected to two securing pads 100 via two springs 102.

The pads are intended to be secured to a support (not shown).

The system further includes an other device 104 intended to be secured to the support by its two ends 106.

This other device 104 includes a mobile stabilising bar 108 and elements 110 intended to form articulations.

As is seen in FIG. 10, bar 108 is secured to fixed ends 106 via certain of elements 110 and mobile table 98 via other elements 110.

Elements 110 are annealed by a laser beam in accordance with the invention so that they form super-elastic flexible elements.

One of the two springs 102 is also annealed by a laser beam in accordance with the invention, for example the left spring, so that it has a shape memory effect.

The other spring, which is not annealed by the laser beam, constitutes a return spring.

Purely by way of non-limiting example, shape memory materials which can be used in the invention are as follows:

AgCd, AuCd, CuZn, CuZnX (where X=Si, Sn, Al or Ga), CuAlNi, CuSn,

CuAuZn, NiAl, TiNi, TiNiX (where X=HF, Cu, Nb, Pd, Co), TiPdNi, InTl, InCd and MnCd.

The present invention also applies to objects made of "magnetic" shape memory material. These are materials whose martensite transformation is able to be induced by a magnetic field. This is for example the case of $Ni_2MnGa$ alloys. With regard to such materials the following may for example be consulted:

R. D. James, M. Wuttig, "Magnetostriction of Martensite", Philosophical Magazine A, 1988, vol. 77, n°5, p.1273 to 1299.

More generally, the present invention applies to all materials exhibiting martensite transformation.

The invention may apply to any type of material shaping. Thus, it applies in particular to wires, strips, tubes, springs, rectangular bars of shape memory alloys.

FIGS. 11 to 25 illustrate schematically various particular applications of the invention.

Figure 11:
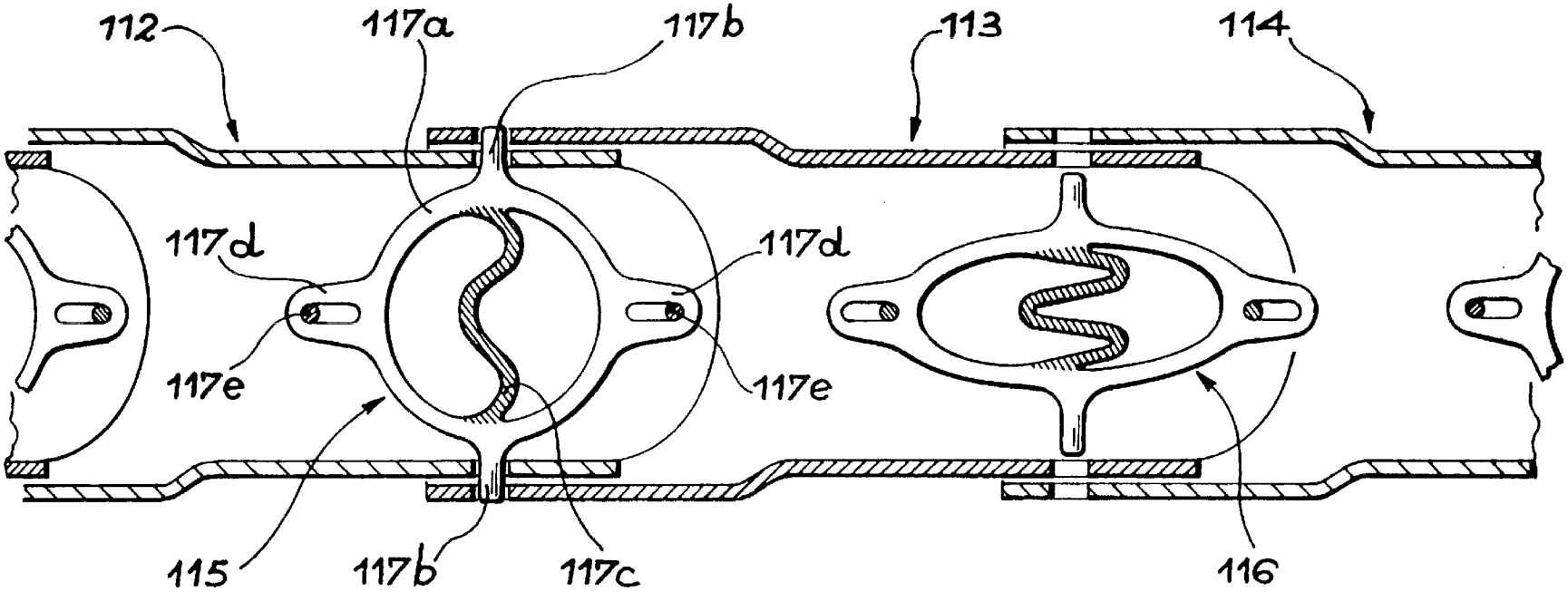
FIGS. 11 to 25 illustrate schematically other applications of the present invention.

FIG. 11 is a top view of a schematic, partial cross-section of a wristband, for example a watch wristband, including links in series such as links 112, 113 and 114. This watch wristband further includes clips 115 and 116, each clip being intended to secure two adjacent links to each other. For example clip 115 is intended to secure links 112 and 113 to each other and clip 116 is intended to secure links 113 and 114 to each other. Each clip, which is located inside one of the links, is made of a shape memory material and includes, in the example shown, a circular peripheral part 117*a* provided with two diametrically opposite stubs 117*b* which are intended to secure the two corresponding links, and a central zig-zag shape zone 117*c* which extends substantially along the diameter corresponding to the stubs. Peripheral part 117*a* is provided with two diametrically opposite extensions 117*d*, at 90° with to stubs 117*b*. As is seen in FIG. 11, these extensions are provided with elongated holes through which pass respectively two pins 117*e* allowing the clip concerned to be secured to one of the two corresponding links and also assuring guiding of the clip. Each central zone is annealed in accordance with the invention.

The design of the wristband allows one or several links to be easily removed or added. To remove a link, one need only remove two adjacent clips, which allows the corresponding link to be removed; the continuity of the wristband is then re-established by means of one of the two clips. To add a link, a clip associated with an already present link is removed, the additional link is added, the clip is replaced to secure the additional link to the link already present and the continuity of the wristband is re-established by means of an additional link.

To add or remove a clip, the clip is heated or the corresponding link is heated locally. The annealed zone 117*c* of the clip is then used as an actuator to deform the elastic structure formed by the non-annealed zone, i.e. the remainder 117*a*, 117*b*, 117*d* of the clip. By deforming, this elastic structure may be inserted in a link (see clip 116 of FIG. 11) or removed therefrom.

Figure 12:
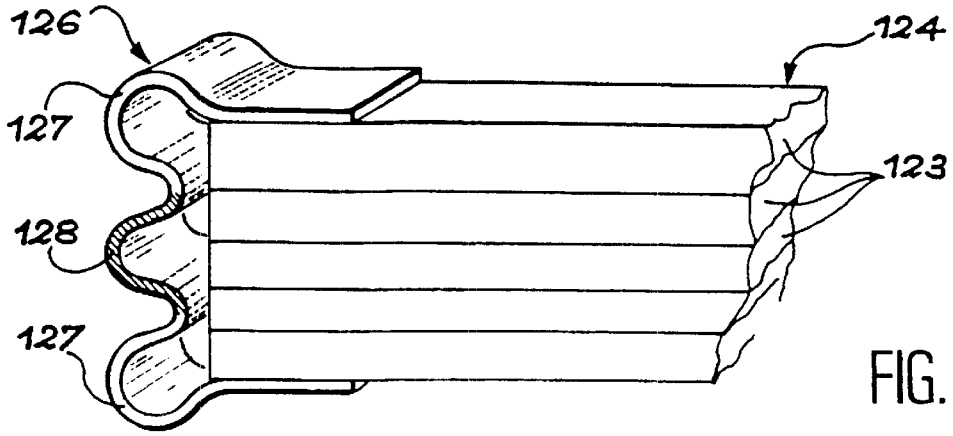

FIG. 12 is an example of a fixing device made of shape memory material with local annealing, obtained by bending a sheet metal of uniform thickness. Local annealing by a method according to the invention may be used to make only the part forming a spring active or super-elastic. Thus, in FIG. 12, the non-annealed zones will be more rigid than the annealed zone, which assures proper gripping. This fixing device may be used for example to fix a stack of small elements 123 such as for example piezoresistive ceramics.

In this FIG. 12, the stack has the reference 124, the fixing device has the reference 126, the non-annealed zones of the fixing device have the reference 127 and the annealed zone has the reference 128. The immobilisation of the stack by the fixing device is thermally induced.

Moreover, the super-elastic properties in the case of a shape memory material can also be advantageously used to have a force which is quasi-independent of the tolerances of the elements of the stack.

Figure 13:
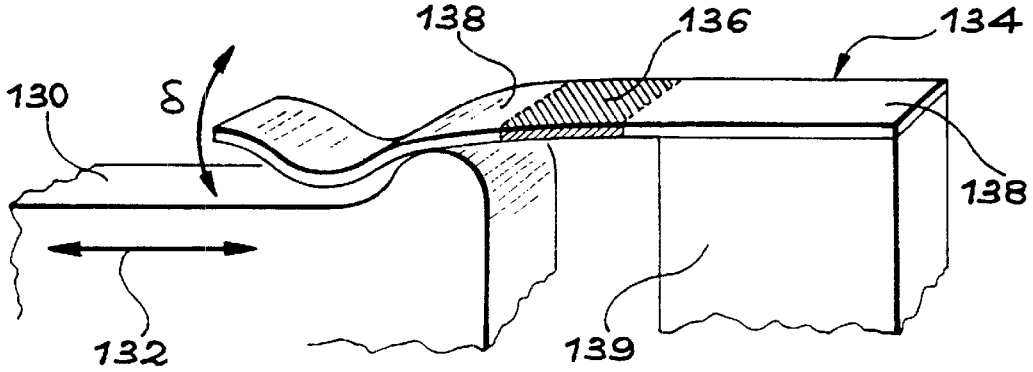

FIG. 13 shows a catch spring currently used in horology. The elasticity is provided by the zone annealed locally by a method according to the invention. Owing to the properties of super-elasticity (force saturation effect), a catch spring may be obtained with a holding force which is independent of the tolerances of the object to be held.

In FIG. 13 the reference 130 represents a part such as for example a watch crown which is mobile in translation along arrow 132, the catch spring, made of shape memory material, has the reference 134, the annealed zone of this spring (central zone) has the reference 136, the non-annealed zones of the spring (end zones) have the reference 138. In the case of FIG. 13 the super-elasticity of zone 136 is thermally induced. The support 139 to which one of the two zones 138 is fixed, the other zone 138 being intended to abut the crown 130 will be noted in FIG. 13.

Figure 14:
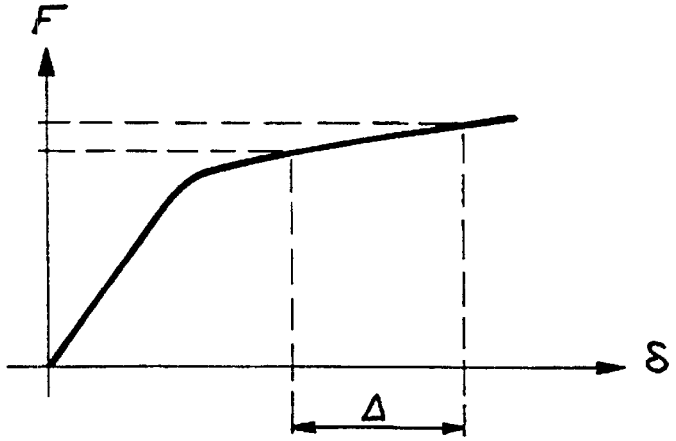

FIG. 14 shows the curve of variations in force F exerted by spring 134 on crown 130 as a function of the displacement $\delta$ of such spring. This curve shows the mechanical behaviour of annealed zone 136. It can be seen that F varies little over a wide range $\Delta$ of displacements $\delta$.

Figure 15:
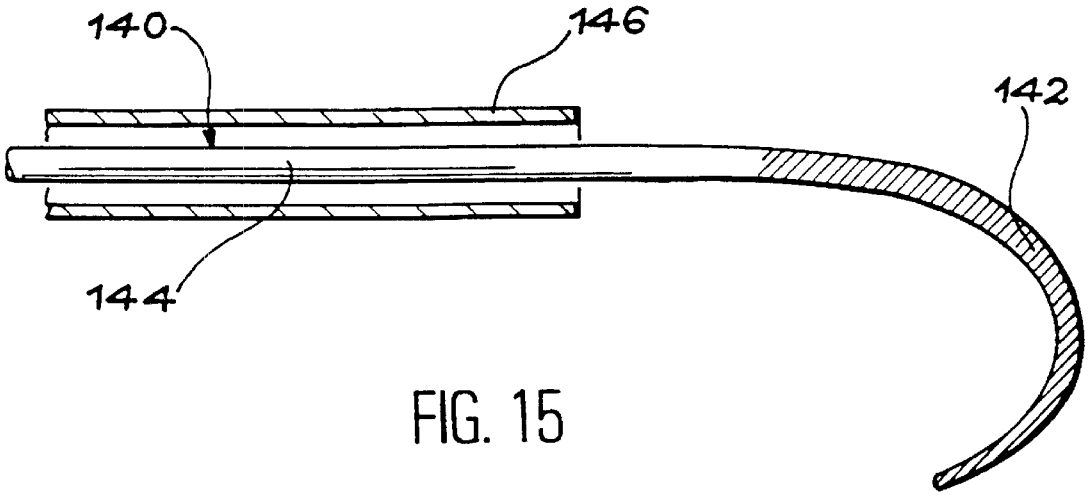

FIG. 15 shows a wire 140 made of shape memory material only an end part 142 of which is annealed by a method according to the invention. This wire may be used as a guide wire in mini-invasive surgery to guide a catheter. Only the end is super-elastic, which enables the curves of the arteries and veins of the human body to be followed without damaging tissue. Rigid part 144 assures good rigidity in torsion, thus avoiding the "whiplash" effect.

The super-elasticity of part 142 is mechanically induced.

Initially, wire 140 is located in a catheter 146. End 142 is then pushed out of the catheter (towards the right in FIG. 15) and this end bends because of its super-elasticity.

Figure 16:
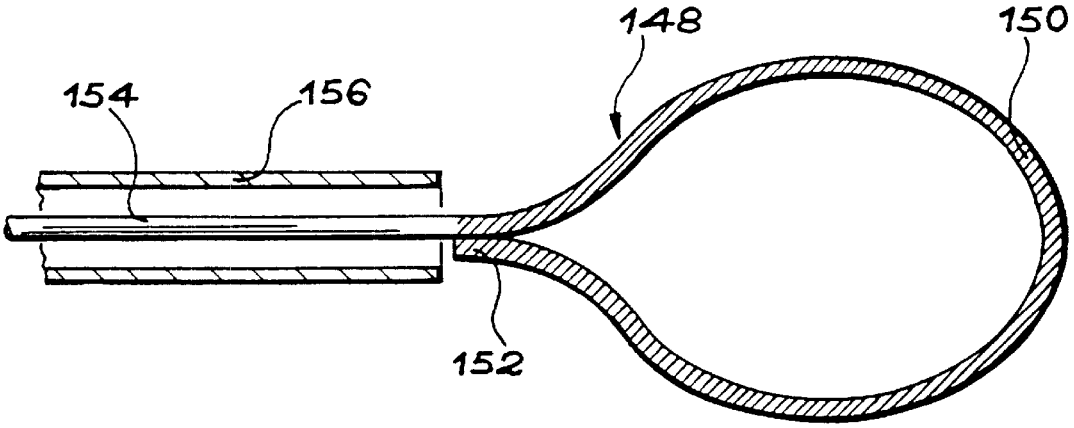

FIG. 16 shows an example of a biopsy clamp 148 which can be used in min-invasive surgery to take tissue samples from the human body. This clamp made of shape memory material forms a lasso of which only the loop 150 is annealed by a method according to the invention. This loop 150 may be closed for example by a weld 152. The non-annealed part 154, which is more rigid, allows good torsion and flexion rigidity.

The super-elasticity of loop 150 is mechanically induced: initially the clamp is in a catheter 156. The end corresponding to the loop is pushed out of the catheter (towards the right in FIG. 15) and this end takes the form of the loop because of its super-elasticity.

Figure 17:
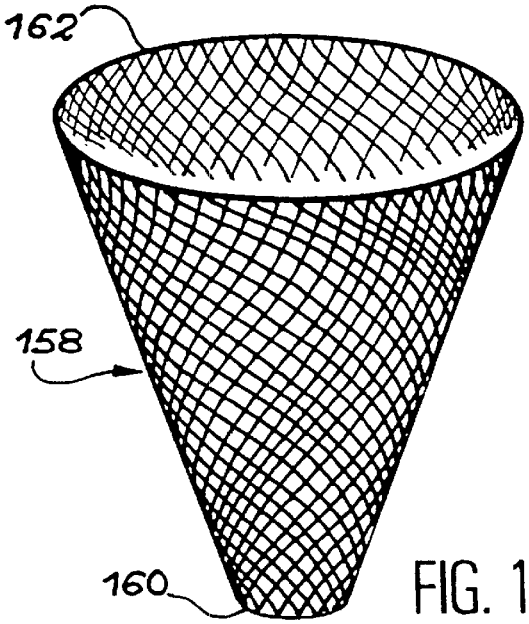

FIG. 17 shows an example of an endocalibrator or stent 158 made of shape memory material. In the case of endocalibrators or stents, local annealing by a method according to the invention allows more or less rigid zones to be created independently of the type of meshing. Thus, the non-annealed zones will not have the same expansion at the catheter outlet as the annealed zones. For example, a cone-shaped stent may be made by progressive annealing on the stent meshing. In FIG. 17, the end 160 of the stent is non-annealed. The rest of the stent is progressively annealed, i.e. the annealing temperature is varied to obtain a variable super-elastic transformation start stress, to the other end 162. In the case of FIG. 17, the super-elasticity is mechanically induced; initially stent 158 is in a catheter (not shown). The stent is then pushed out of the catheter and the stent takes its cone shape as seen in FIG. 17.

Figure 18:
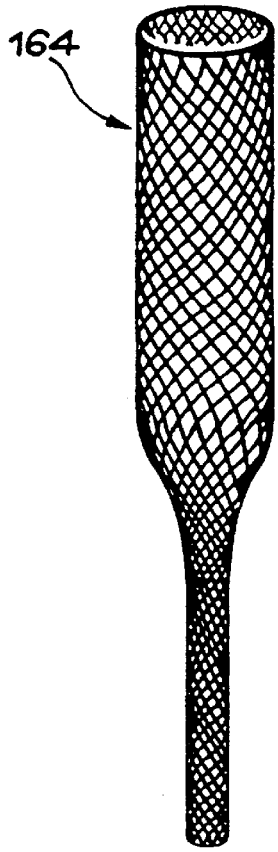
Figure 19:
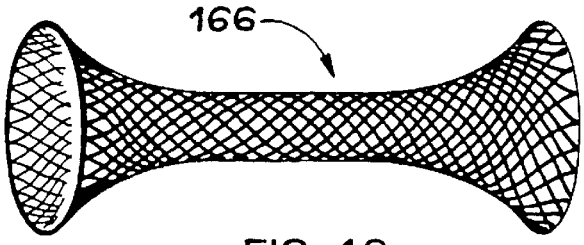
Figure 20:
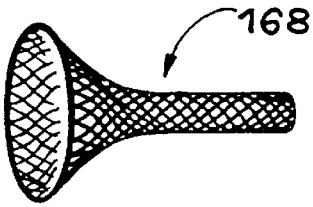
Figure 21:
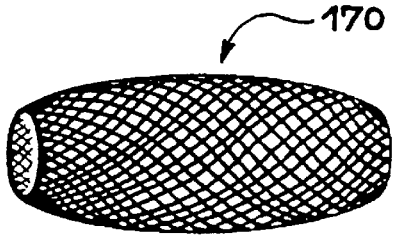

FIGS. 18 to 21 show other examples of stents made of shape memory material, obeying the same principle as that of FIG. 17. In the case of FIG. 18, there is a stent 164 capable of taking an elongated shape with two diameters. Other spatial geometries are possible for a stent: in the case of FIG. 19 stent 166 takes a shape with two ends of greater diameter than the rest of the stent. In the case of FIG. 20, stent 168 takes a flared shape. In the case of FIG. 21, stent 170 takes a shape which bulges at the centre.

Figure 22:
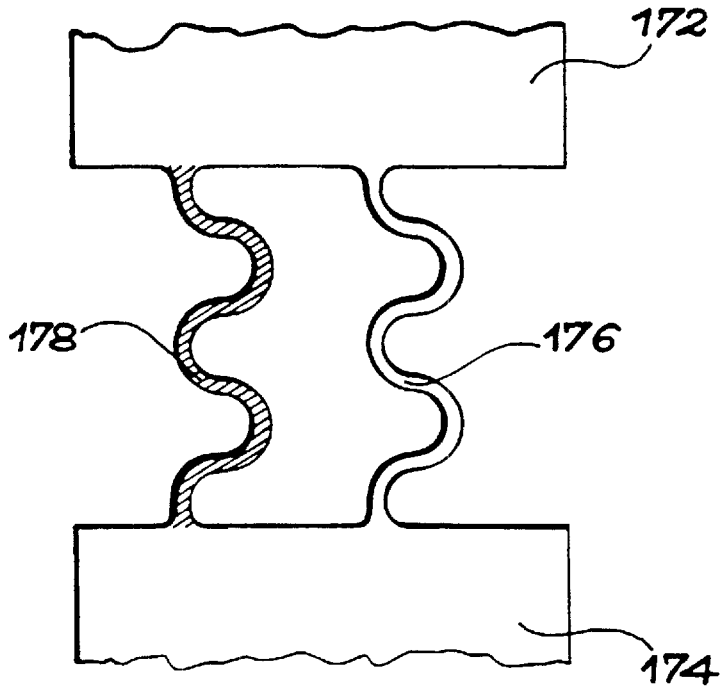
Figure 23:
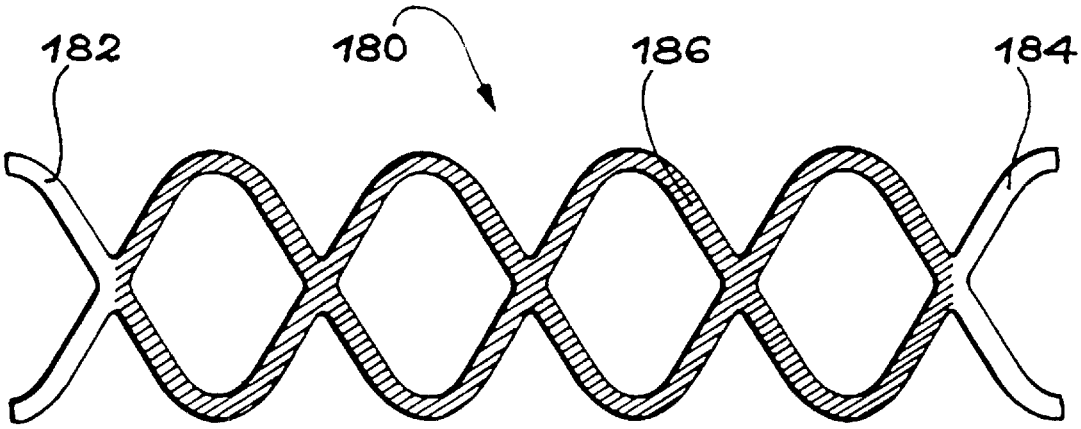

FIG. 22 is a schematic view of a damping system made of shape memory material and including two parts 172 and 174 connected by two zig-zag shaped and substantially parallel elements 176 and 178. Element 176 is not annealed while element 178 is annealed by a method according to the invention. It is known that shape memory alloys have the property of having a very high dampening rate in martensite (this being due to internal friction in the material). With local annealing, a spring with an integrated damping device can be made. Thus non-annealed element 176 behaves like a normal spring while annealed element 178 is able of acting as a damping device FIG. 23 is a schematic view of an unfolded monolithic watch wristband 180 made of shape memory material. Only the ends parts 182 and 184 of the wristband, which have to be secured to the watch case (not shown) are not annealed. The central part 186 of the wristband, which is comprised between parts 182 and 184 is thus annealed by a method according to the invention and the annealing may be progressive depending upon the desired level of rigidity. Various decorative elements (not shown), for example ceramic plates, may be added to the structure thereby obtained. Such a wristband may be made to measure.

Figure 24:
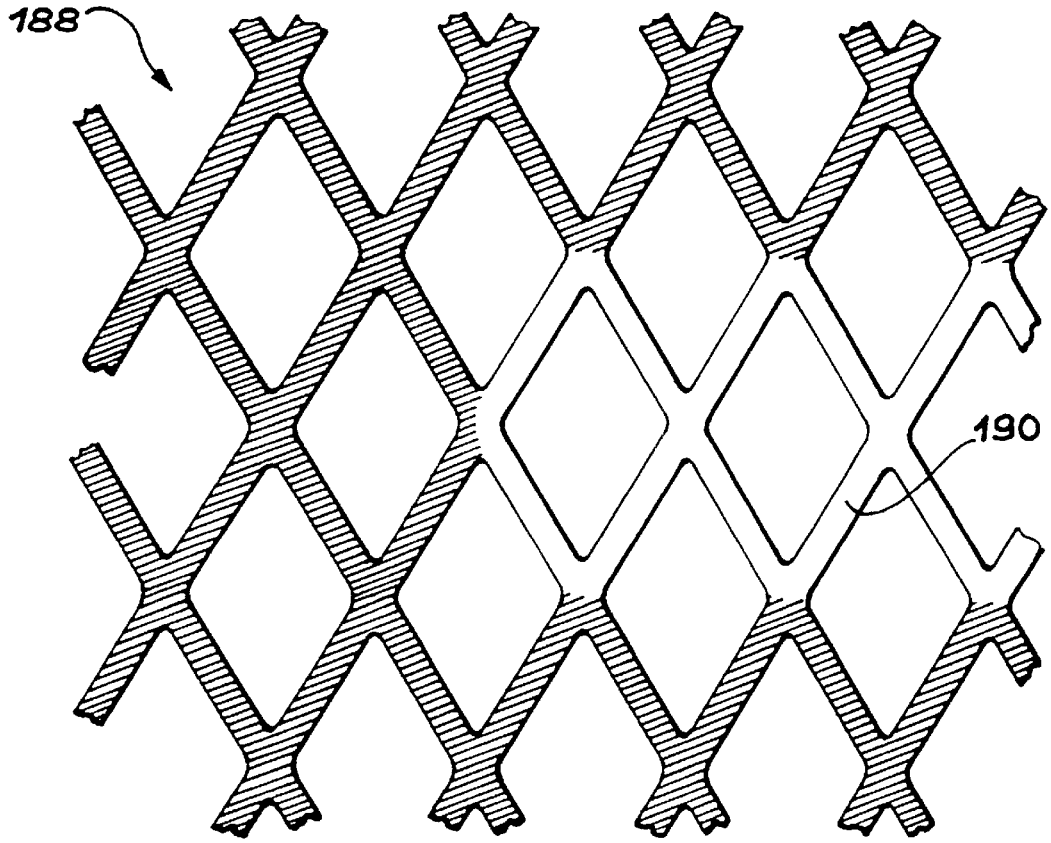

FIG. 24 is a schematic partial view of a stent 188 made of shape memory material. The whole of the stent meshing is annealed by a method according to the invention, except a limited number N of meshes with <N<10 (zone referenced 190 in FIG. 24).

Figure 25:
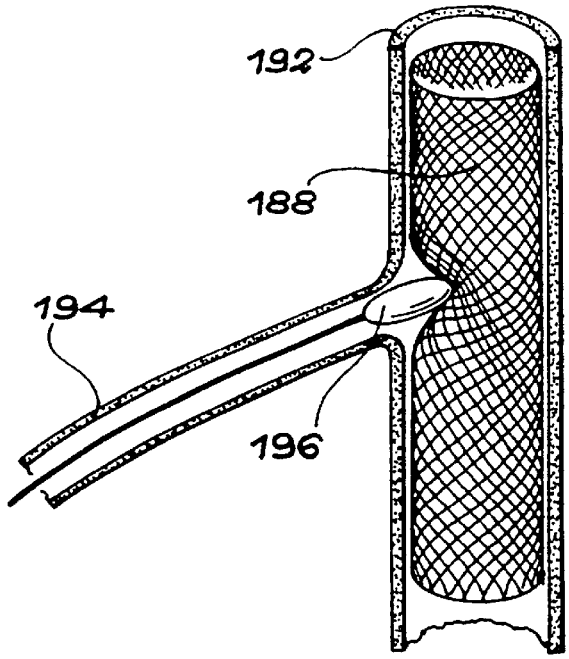

FIG. 25 illustrates schematically an application of the stent of FIG. 24. This stent 188 is placed in an artery 192. Another artery 194 which communicates with artery 192 but is blocked by the meshing of stent 188 can also be seen. In order to overcome this drawback, the non-annealed meshes are plastically deformed using a surgical balloon 196 brought into contact with these meshes by passing through artery 194 and of the type of those used to unfold steel stents. These deformed meshes allow blood circulation to be re-established in artery 194.

Owing to a guide-wire inserted beforehand in artery 192 and bifurcating in artery 194, the balloon can also be introduced via artery 192 by passing through the interior of the stent itself and then bifurcating at artery 194.

What is claimed is:

1. Method for treating an object made of a material capable of exhibiting a shape memory effect, but having an amorphous or work-hardened structure with no shape memory before said treating, this method being characterised by: irradiating at least a pre-defined zone of this object by a laser beam able to heat this zone sufficiently, to a temperature lower than the melting temperature of the material, to cause, in said zone, a microstructure change selected from among a crystallisation, recrystallisation, secondary crystallisation, controlled formation of precipitates and annihilation of crystalline faults; and heating said zone to a temperature and for a time which are not able to cause amorphisation of the material.

2. Method according to claim 1, wherein said irradiating of the zone is also used to cause permanent deformation of said zone allowing the object to be stressed.

3. Method according to claim 1, wherein, before or during, or after irradiation of the zone, the object is stressed by deforming said object.

4. Method according to claim 1, wherein the non irradiated part of the object is all in one piece.

5. Method according to claim 1, wherein the non irradiated part of the object includes at least two zones which are separated by the irradiated zone.

6. Method according to claim 1, wherein the object is a thin element, and further characterized by irradiating zones of this element, which are distributed over said element, by means of said laser beam in order to rigidify said element.

7. Method according to claim 1, wherein energy transmitted to the material by the laser is varied as a function of the position of the laser beam on the object.

* * * * *